US010813523B2

(12) United States Patent
Pierce, Jr.

(10) Patent No.: US 10,813,523 B2
(45) Date of Patent: Oct. 27, 2020

(54) MOP WITH ADVANCING CLEANING FABRIC MATERIAL

(71) Applicant: Alfred Raymond Pierce, Jr., Mount Holly, NJ (US)

(72) Inventor: Alfred Raymond Pierce, Jr., Mount Holly, NJ (US)

(73) Assignee: Infiniti Cleaning Solutions, LLC., Mount Holly, NJ (US)

( * ) Notice: Subject to any disclaimer, the term of this patent is extended or adjusted under 35 U.S.C. 154(b) by 0 days.

(21) Appl. No.: 15/886,777

(22) Filed: Feb. 1, 2018

(65) Prior Publication Data

US 2018/0213997 A1 Aug. 2, 2018

Related U.S. Application Data

(60) Provisional application No. 62/453,201, filed on Feb. 1, 2017.

(51) Int. Cl.

| | |
|---|---|
| ***A47L 13/22*** | (2006.01) |
| ***A47L 11/40*** | (2006.01) |
| ***A47L 13/256*** | (2006.01) |
| ***A47L 13/17*** | (2006.01) |

(52) U.S. Cl.

CPC ..... *A47L 13/225* (2013.01); *A47L 11/4041* (2013.01); *A47L 11/4083* (2013.01); *A47L 11/4086* (2013.01); *A47L 11/4088* (2013.01); *A47L 13/17* (2013.01); *A47L 13/256* (2013.01)

(58) Field of Classification Search

CPC ..... A47L 13/225; A47L 11/4041; A47L 11/4083; A47L 11/4086; A47L 11/4088; A47L 13/17; A47L 13/256; A47L 11/4047; A47L 11/4069; A47L 11/29; A47L 11/4016; A47L 11/4075

See application file for complete search history.

(56) References Cited

U.S. PATENT DOCUMENTS

| | | | | |
|---|---|---|---|---|
| 2,601,690 A * | 7/1952 | Georgas | ..... | A47L 11/4069 15/99 |
| 2,834,645 A * | 5/1958 | Birr | ..... | A47K 10/28 312/34.15 |
| 5,327,609 A * | 7/1994 | Bierma | ..... | A47L 11/00 15/228 |

(Continued)

FOREIGN PATENT DOCUMENTS

JP H07-327904 * 12/1995

*Primary Examiner* — Robert J Scruggs
(74) *Attorney, Agent, or Firm* — Christopher Feigenbutz

(57) ABSTRACT

A mop is disclosed. The mop includes a handle, an elongated shaft, a first reservoir, and a housing. Contained within the housing is a rolled cleaning fabric material cartridge, which can be pre-wetted or dry. The mop further includes one or more spray nozzles that are fluidly connected to the reservoir for dispensing a solution. A motor advances the cleaning fabric material, wherein the motor is preprogrammed to advance the material so that a completely new section of material covers the mop surface area and the used section of the material is advanced into said housing. The mop can further include a front extension on the leading edge of the housing that enables the cleaning fabric material to reach under the edge of a cabinet to increase the reach of the device.

6 Claims, 8 Drawing Sheets

(56) References Cited

U.S. PATENT DOCUMENTS

| | | | | |
|---|---|---|---|---|
| 6,859,976 | B2 * | 3/2005 | Plankenhorn | A47L 11/22 15/364 |
| 8,650,692 | B2 * | 2/2014 | Liu | A47L 11/4013 15/1.51 |
| 9,265,396 | B1 * | 2/2016 | Lu | A47L 9/2815 |
| 2002/0011813 | A1 * | 1/2002 | Koselka | A47L 11/24 318/445 |
| 2014/0076359 | A1 * | 3/2014 | Hansen | A47L 11/34 134/6 |
| 2014/0259510 | A1 * | 9/2014 | Conrad | A47L 13/225 15/319 |
| 2015/0305588 | A1 * | 10/2015 | Dingert | A47L 13/22 15/320 |

* cited by examiner

MOP WITH ADVANCING CLEANING FABRIC MATERIAL

CROSS REFERENCE TO RELATED APPLICATION

This application claims the benefit of U.S. Provisional Application No. 62/453,201, filed on Feb. 1, 2017, entitled "Mop with Advancing Cleaning Fabric Material." The above identified patent application is herein incorporated by reference in its entirety to provide continuity of disclosure.

BACKGROUND OF THE INVENTION

1. Field of the Invention

The present invention relates to cleaning implements. More particularly, the present invention pertains to a mop.

Mops are traditionally used for cleaning hard surfaces, such as linoleum, wood, and tile floors. Conventional mops require constant cleaning and rewetting, which often is accomplished with a wringer and bucket. This type of system requires a user to fill a bucket with a solution, wet the mop head, clean the floor, and periodically wring out the mop head to remove dirt. Once wrung out, new cleaning solution must be applied to enable cleaning to continue.

The problem inherent with conventional mopping systems is that as the user continues to clean, the bucket containing the solution retains the dirt removed from the surface. As the mop is placed in the bucket to apply new solution thereto, it makes contact with the dirt, which can then be reapplied to the clean floor. Ensuring that all the dirt is removed from the floor with such a system is labor intensive and time consuming. Other types of cleaning mops use a single cleaning cloth that is placed on a flat surface area on the bottom of the mop. These types of mops require constant personal handling and replacement of the single cleaning cloth as it quickly becomes soiled and dirty.

SUMMARY OF THE INVENTION

The present invention overcomes the problems inherent in conventional mops by providing a self-contained system that does not require the use of a bucket or wringing mechanism, or the constant and frequent personal handling and changing of dirty, soiled cleaning cloths. The device comprises a handle, an elongated shaft, a first reservoir, and a housing. Contained within the housing is a rolled cleaning fabric material cartridge, which can be pre-wetted or dry. The mop further includes one or more spray nozzles that are fluidly connected to the reservoir for dispensing a solution. A motor advances the cleaning fabric material, wherein the motor is preprogrammed to advance the material so that a completely new section of material covers the mop surface area and the used section of the material is advanced into said housing. The mop can further include a front extension on the leading edge of the housing that enables the cleaning fabric material to reach under the edge of a cabinet to increase the reach of the device.

The device can be constructed in a manner that does not require a solution to be dispensed. This is accomplished by providing the material in a pre-wetted format as a cleaning cartridge in a sealed bag, wherein the material is already wet with a cleaning solution.

The material is attached to the first internal roller at the first end, passes through a first opening in the housing, along and beneath a bottom surface of the housing, into a second opening in the housing, and attaches at the second end to the second internal roller. The material can be advanced as desired, thereby ensuring that a cleaning surface free of dirt and debris is constantly being used, which in turn prevents the surface from being soiled with dirt that has already been collected by the cleaning fabric.

In a first alternate embodiment, the present invention includes a front extension on the leading edge of the mop that enables the cleaning fabric material to reach under the edge of a cabinet to increase the reach of the device. In a second alternate embodiment, the mop of the present invention can be designed as an automated system that can be programmed to clean without the need for human intervention.

The present invention substantially diverges in design elements from the prior art and consequently it is clear that there is a need in the art for an improvement to existing mops. In this regard the instant invention substantially fulfills these needs.

OBJECTS OF THE INVENTION

In view of the foregoing disadvantages inherent in the known types of mops now present in the prior art, the present invention provides a mop wherein the same can be utilized for providing convenience to the user for cleaning surfaces without the need for a bucket, ringer, or the constant replacement of the cleaning fabric.

It is therefore an object of the present invention to provide a new and improved mop device that has all of the advantages of the prior art and none of the disadvantages.

It is another object of the present invention to provide a mop device with a length of rolled cleaning fabric material contained within a housing.

Another object of the present invention is to provide a mop device with a means of advancing the length of the cleaning fabric material, thereby ensuring that a cleaning surface free of dirt and debris is constantly being used.

Yet another object of the present invention is to provide a mop device that is designed to reach underneath cabinets to extend the reach of the cleaning fabric material The mop device may be readily fabricated from materials that permit relative economy and are commensurate with durability. Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
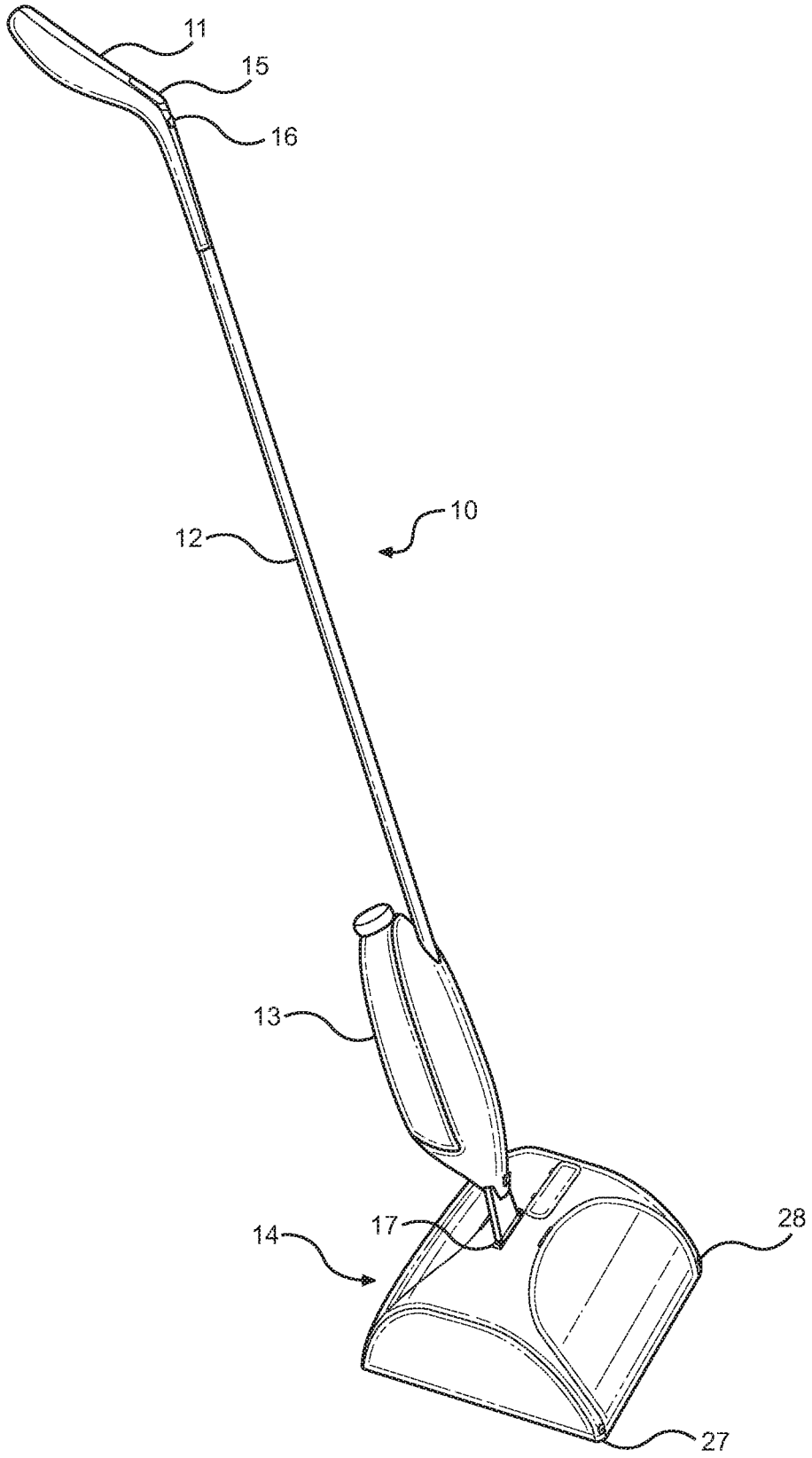
FIG. 1 is a perspective view of the invention.

Reference is made herein to the attached drawings. Like reference numerals are used throughout the drawings to depict like or similar elements of the mop device. For the purposes of presenting a brief and clear description of the present invention, the preferred embodiment will be discussed as used for cleaning a floor. The figures are intended for representative purposes only and should not be considered to be limiting in any respect.

Referring now to FIG. 1, there is shown a perspective view of the mop 10 of the invention. The device comprises a handle 11, an elongated shaft 12, a reservoir 13, and a main mop head housing 14. The handle 11 controls the mop 10 in a conventional manner that would be understood by one of ordinary skill in the art. The handle 11 further includes a pair of control buttons 15, 16. The first control button 15 functions as a power switch for the motor, which is contained within the main mop head housing 14. The second control button 16, operates one or more spray nozzles 27, 28 that are disposed on the main mop head housing 14 for dispensing a liquid stored in the reservoir 13. The handle 11 and shaft 12 are connected to the main mop head housing 14 via a hinge 17. The hinge 17 enables a user to move the mop 10 about a surface for cleaning, while ensuring that the housing 14 remains in contact with the surface. Alternately, the hinge 17 can be designed to change the direction of travel of the housing 14, wherein as the user turns the handle 11 the direction of the housing 14 turns in a corresponding manner. Alternately, the reservoir 13 can be contained in the housing 14 as opposed to attached to the handle 12.

Figure 2:
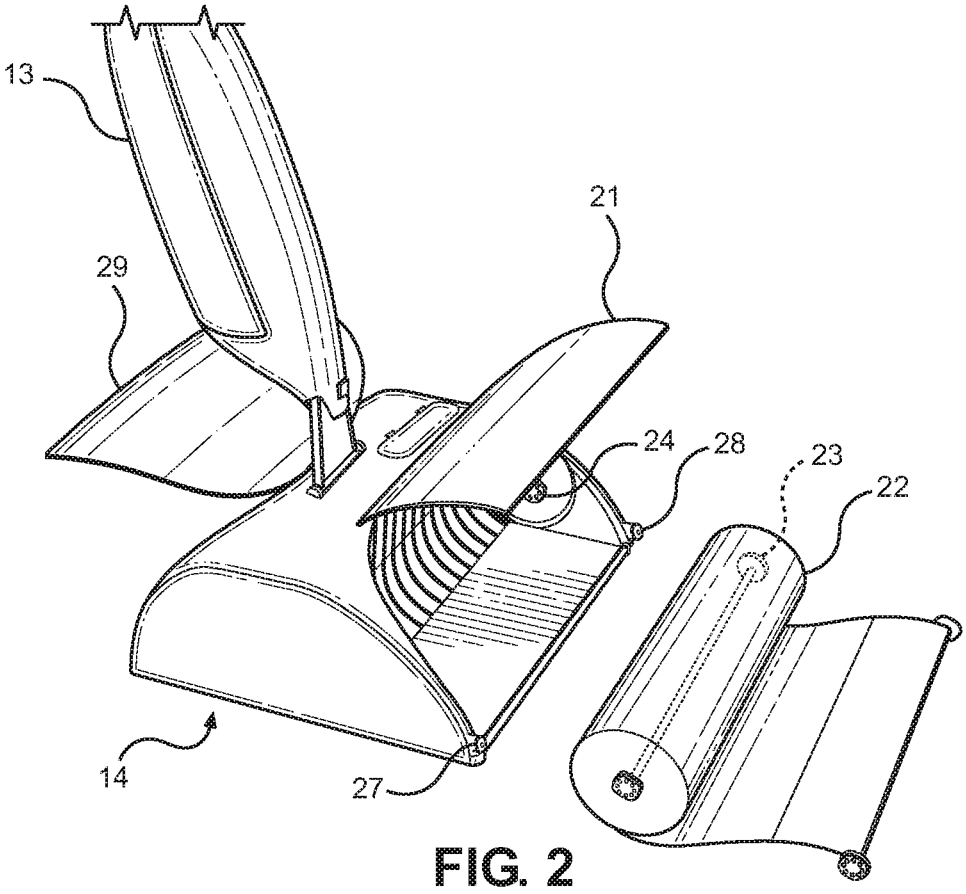
FIG. 2 is a close-up perspective view of the main mop head housing.

Referring now to FIG. 2, there is shown a close-up perspective view of the main mop head housing 14. The housing 14 comprises a first hinged lid 21 and a second hinged lid 29. Contained within the first lid 21 is a rolled cleaning fabric material 22. The material 22 makes contact with a surface to be cleaned when the mop is in use. The material 22 is secured in position within the first lid 21 via a first rotating roller 23 that attaches to a first sidewall locking mechanism 24. In the preferred embodiment, the sidewall locking mechanism 24 comprises a male or female locking means opposite of the first rotating roller 23, which utilizes a mating female or male locking means to secure the first rotating roller 23 and material 22 in position.

The material 22 is contained in a rolled configuration, and is disposed on the first rotating roller 23. The material 22 can be constructed from a variety of materials in order to afford superior cleaning. The material may be dry, wherein steam is added thereto, or the spray nozzles 27, 28 provide a cleaning solution that is mopped by the device to add moisture thereto. As can be appreciated by one of ordinary skill in the art, the material to be used can be selected based on the surface to be cleaned.

Alternately, the device can be constructed in a manner that does not require a solution to be dispensed. This is accomplished by providing the material in a pre-wetted format as a cleaning cartridge in a sealed bag, wherein the material is already wet with a cleaning solution. This embodiment is particularly beneficial for times when a user knows the surface area to be cleaned may use the entire roll of the cleaning cartridge wet cloth. As a non-limiting example, a user who needs to clean three to four rooms or floors may use an entire cleaning cartridge. The pre-wetted cleaning cartridges contain a predefined amount of cleaning cloth to clean a predefined number of rooms or square footage.

Figure 4:
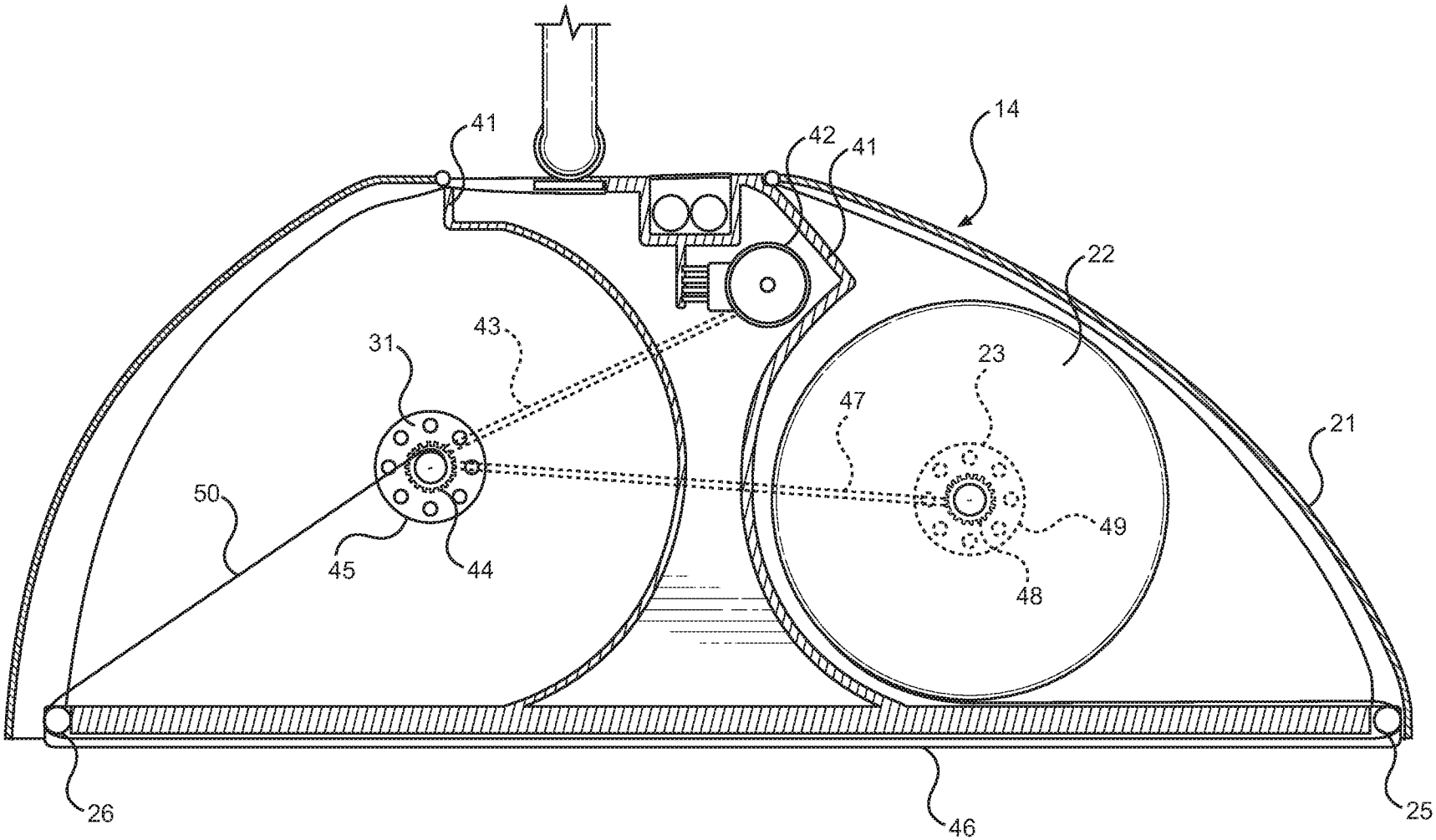
FIG. 4 is a cross-sectional side view of the mop head housing.

The second hinged lid 29 provides access to the rear interior area of the housing 14. As best illustrated in FIG. 4, the front and rear of the housing 14 preferably include a first rolling spindle 25 and a second rolling spindle 26 that assist with the stabilization and advancement of the material 22. Also contained on the front of the housing 14 are a pair of spray nozzles 27, 28 for dispensing a liquid stored in the reservoir 13.

Figure 3:
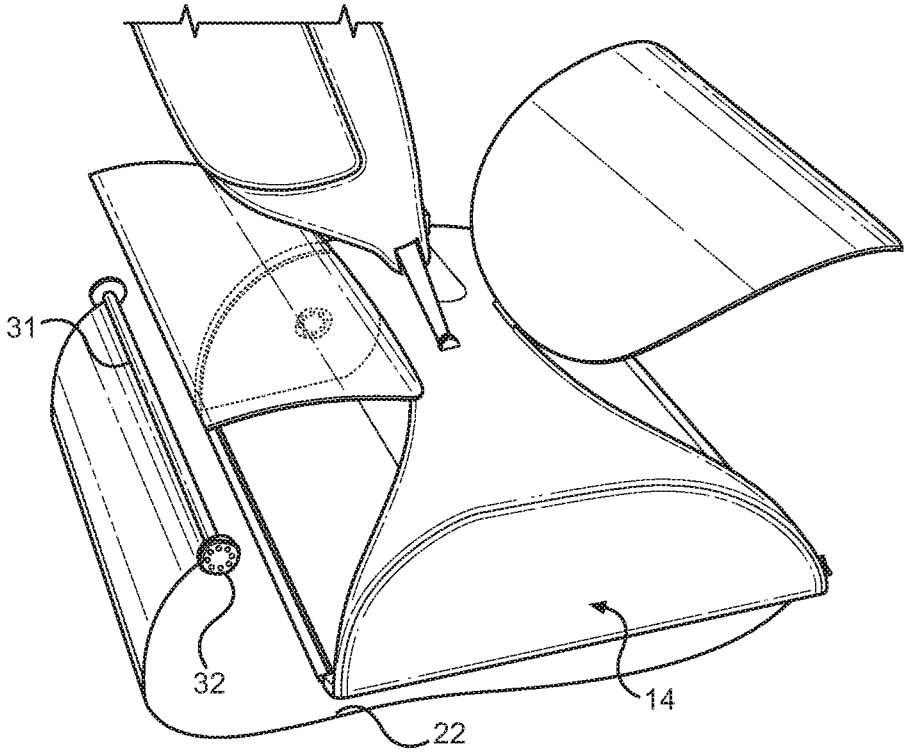
FIG. 3 is a perspective side view of the rear main mop head housing.

Referring now to FIG. 3, there is shown a perspective side view of the rear main mop head housing 14. The end of the material 22 attaches to a second rotating roller 31, which is held in position within the rear portion of the housing 14 via a second sidewall locking mechanism (not shown) comprising a male or female locking means. The ends of the second rotating roller 31 include a lock 32 for locking the second rotating roller 31 to the second sidewall locking mechanism inside the housing 14. The rotation of the first rotating roller 23 (as shown in FIG. 2) and second rotating roller 31 are controlled via the control button 15, which advances the material 22 and removes slack therein.

Referring now to FIG. 4, there is shown a cross-sectional side view of the mop head housing 14. The cleaning fabric material 22, is housed in the front section of the housing 14 between the first lid 21 and wall 41. The material 22 is advanced via a motor 42. The motor 42, which is preferably battery powered, provides power to the rotor 43, which operates and spins the primary gear 44. The primary gear 44 applies rotational force to the rear sidewall mechanism 45 in either a clockwise or counter-clockwise motion, rotating the second rotating roller 31. The rotation of the roller 31 advances the material 22 around the roller 31 until a new cleaning fabric material covers the bottom of the mop surface area 46. The motor 42 is preprogrammed to advance the material 22 so that a completely new section of material 22 covers the mop surface area 46 and the used section of material is advanced into the housing. In a first alternate embodiment, the motor 42 can advance the material 22 as long as the button is depressed. In a second alternate embodiment, the device can utilize a hand crank to advance the material 22.

In an alternate embodiment, the device includes a secondary rotor 47, which is attached to a primary gear 44 and secondary gear 48. As the motor 42 applies rotational force, the secondary rotor 47 and gears 44, 48 are rotated via the front side locking mechanism 49 that advances the front clean fabric material 22 contained on the rotating roller 23. The material 22 is stretched between the first rolling spindle 25 and the second rolling spindle 26, wherein the material between the spindles 25, 26 make contact with the surface to be cleaned.

Figure 5:
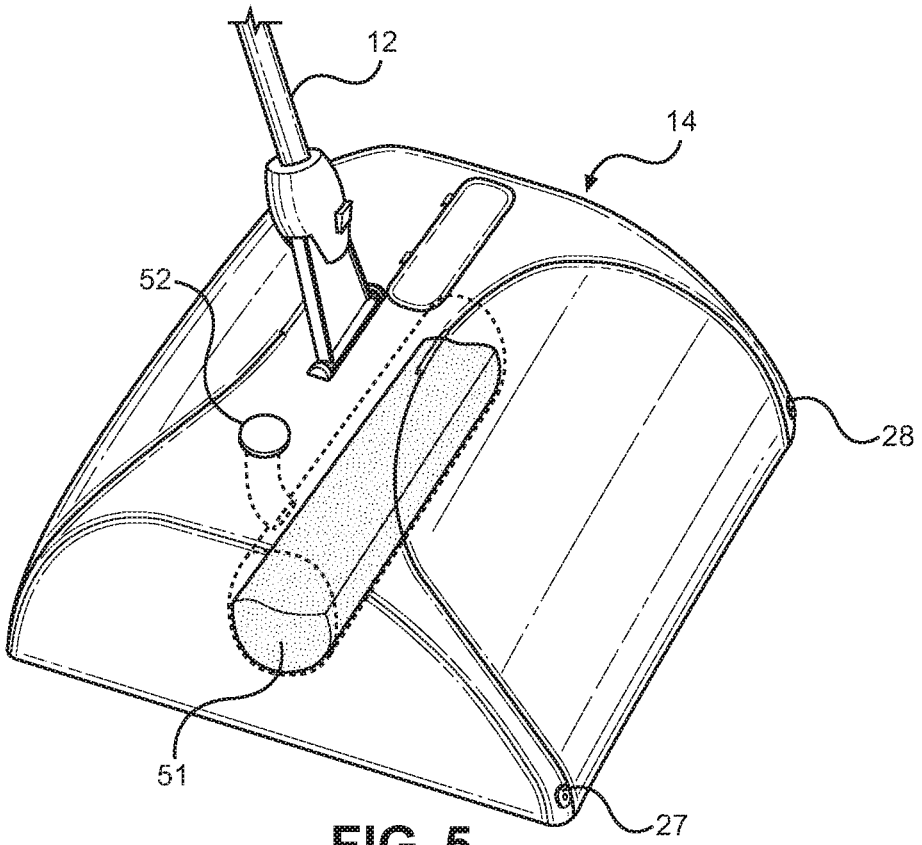
FIG. 5 is perspective side view of the front of the mop head.

Referring now to FIG. 5, there is shown a perspective side view of the front of the mop head 10. In the first embodiment, the reservoir 13 (as shown in FIG. 1) is disposed on the elongated shaft 12 and above the housing 14. In an alternate embodiment, the reservoir 51 is disposed within the housing 14. The reservoir 51 preferably contains hot water, cold water, a liquid cleaning solution, or a combination thereof. The reservoir 51 is filled via a cap 52 disposed on the exterior surface of the housing 14. This configuration reduces the mass applied to the shaft 12 and redistributes the mass to within the housing 14, which may afford additional control to the user when using the mop. A solution is poured into the reservoir 51, and is dispensed through the spray nozzles 27, 28. In an alternate embodiment, the mop 10 includes a reservoir 11 on the elongated shaft 12 (as shown in FIG. 1), and an internal reservoir 51. In this configuration, the external reservoir 11 provides a cleaning solution to the spray nozzles 27, 28, while the internal reservoir 51 generates steam to be released through the bottom of the mop 10. In a first alternate embodiment, the device can include a single spray nozzle located in the center of the housing. Alternately, the device can be constructed with one reservoir, or without a reservoir, such that the present invention will be utilized with pre-wetted material.

Figure 6:
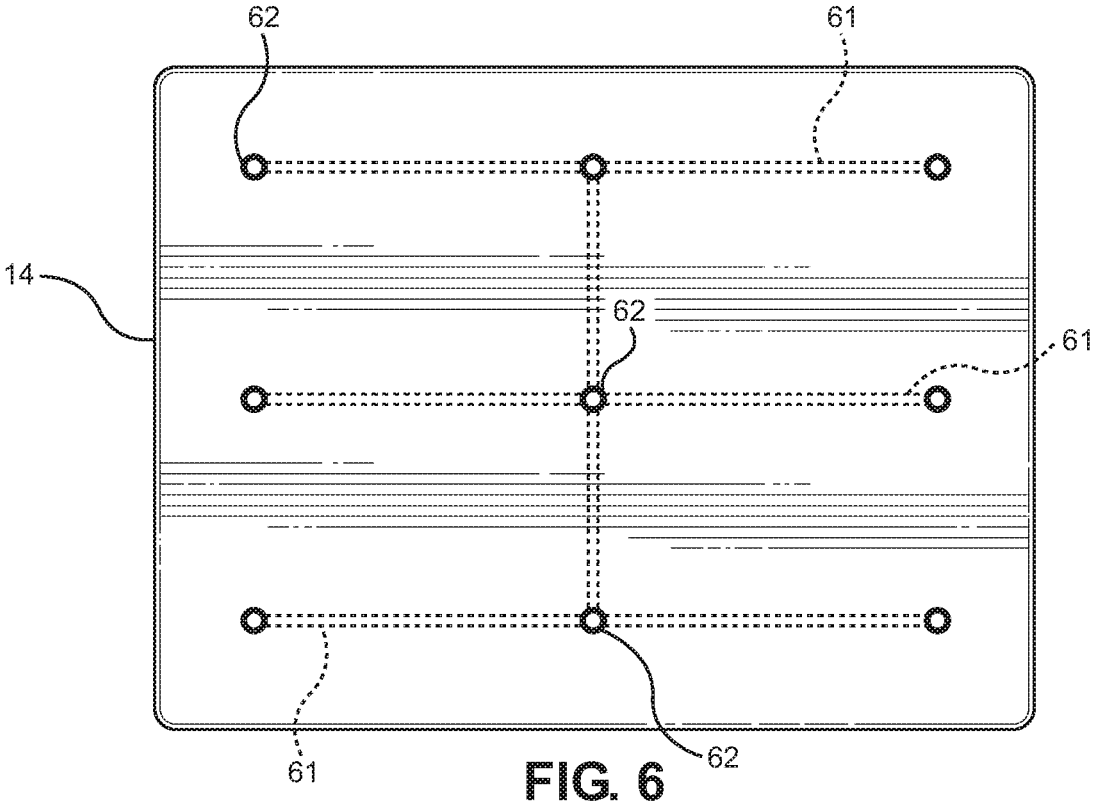
FIG. 6 is a bottom view of the mop head.
Figure 7:
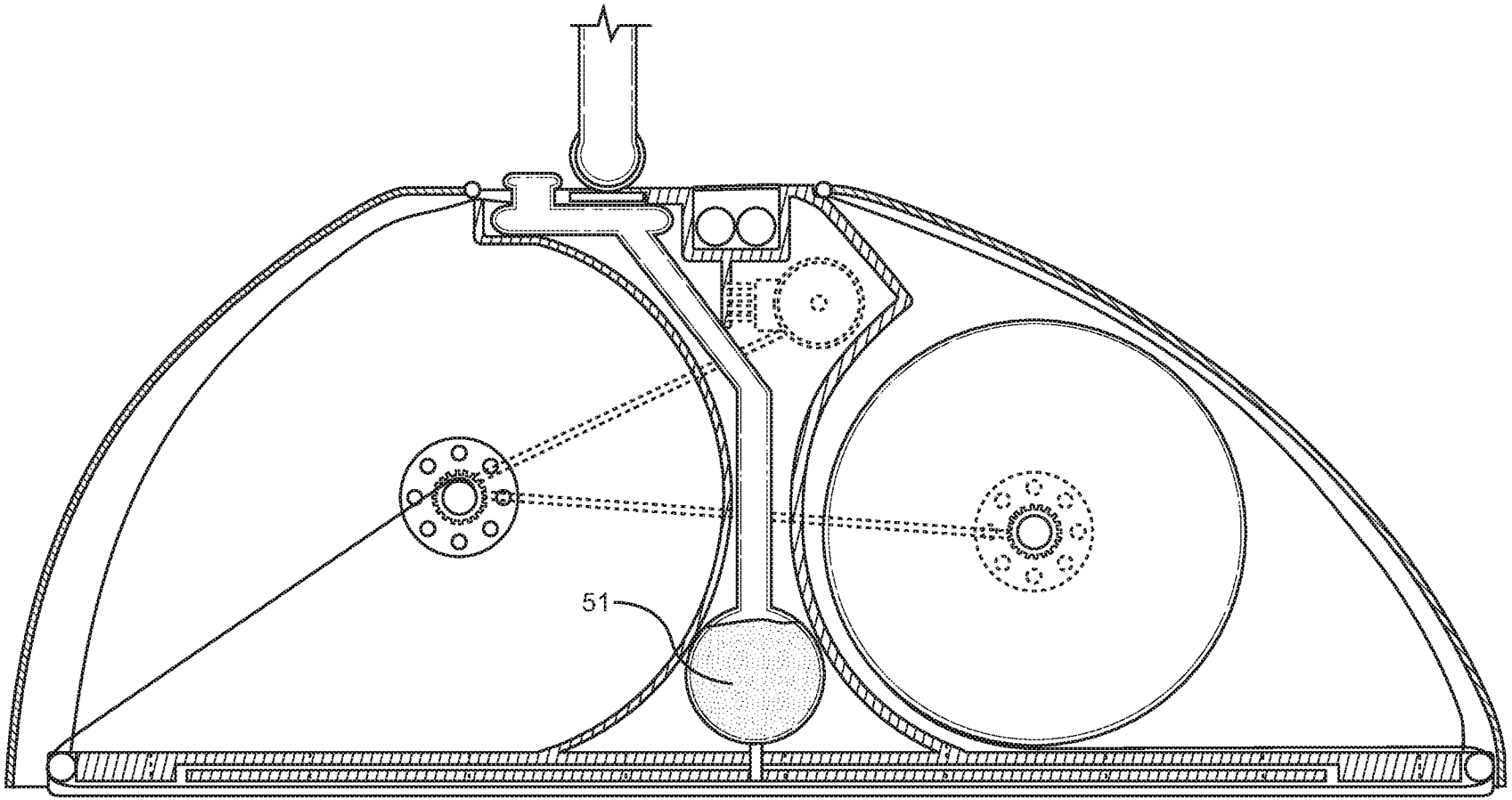
FIG. 7 is a cross-sectional side view of the mop head housing with an internal reservoir.

Referring now to FIG. 6, there is shown a bottom view of the mop head 10. In this embodiment, the device includes a means for generating steam. The base of the device includes a plurality of feed lines 61 that release steam that is generated within the housing 14. As shown in FIG. 7, the reservoir 51 comprises a heating element (not shown) disposed therein to create steam, which is released through the feed lines 61 to aid with cleaning. Steam is generated via the heating element, and the steam is released through the feed lines 61 and through the outlets 62. The steam makes contact with the material (not shown) to provide heat and moisture thereto, which in turn provides improved cleaning to some surfaces.

Figure 8:
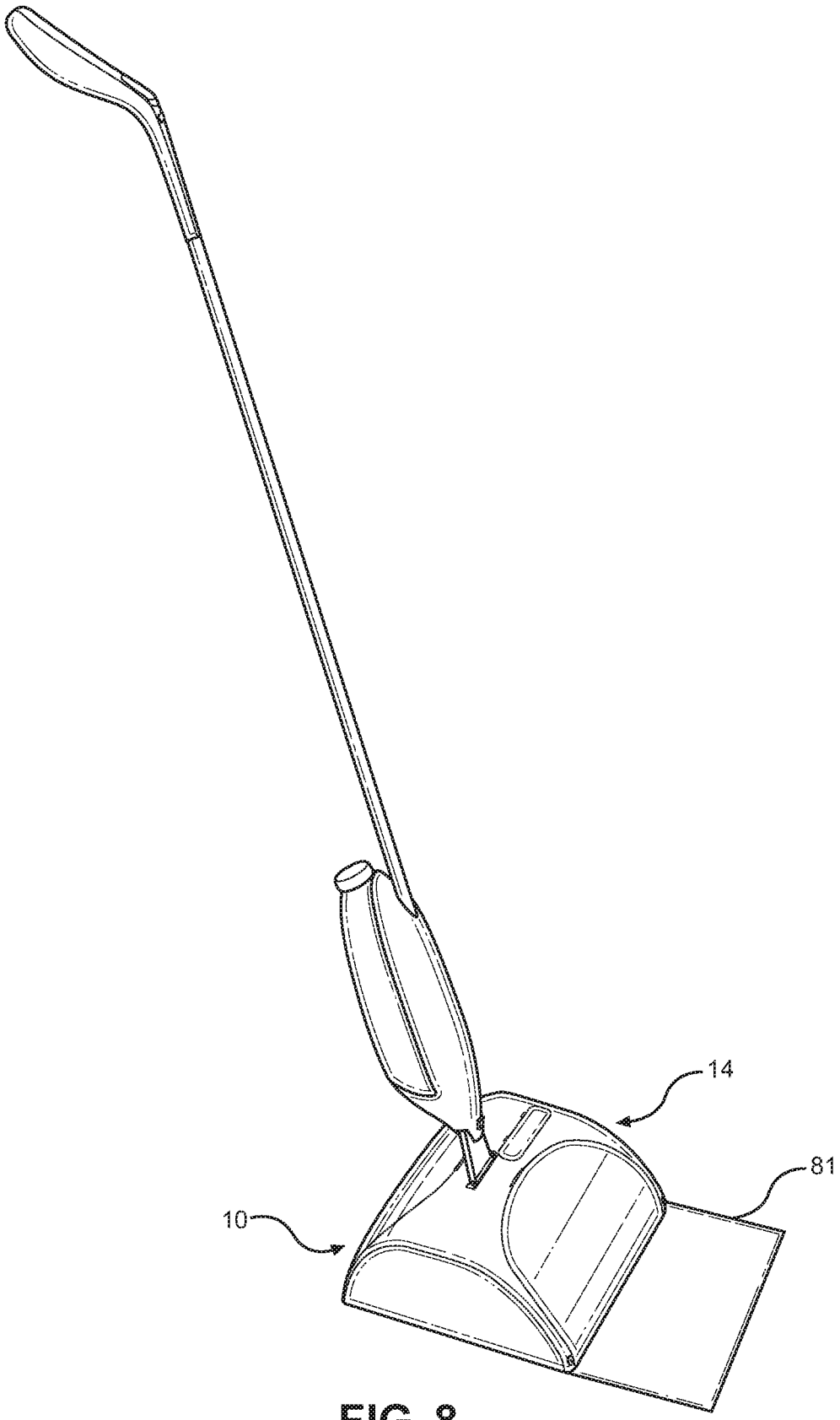
FIG. 8 is a perspective view of an alternate embodiment of the present invention with a front extension.
Figure 9:
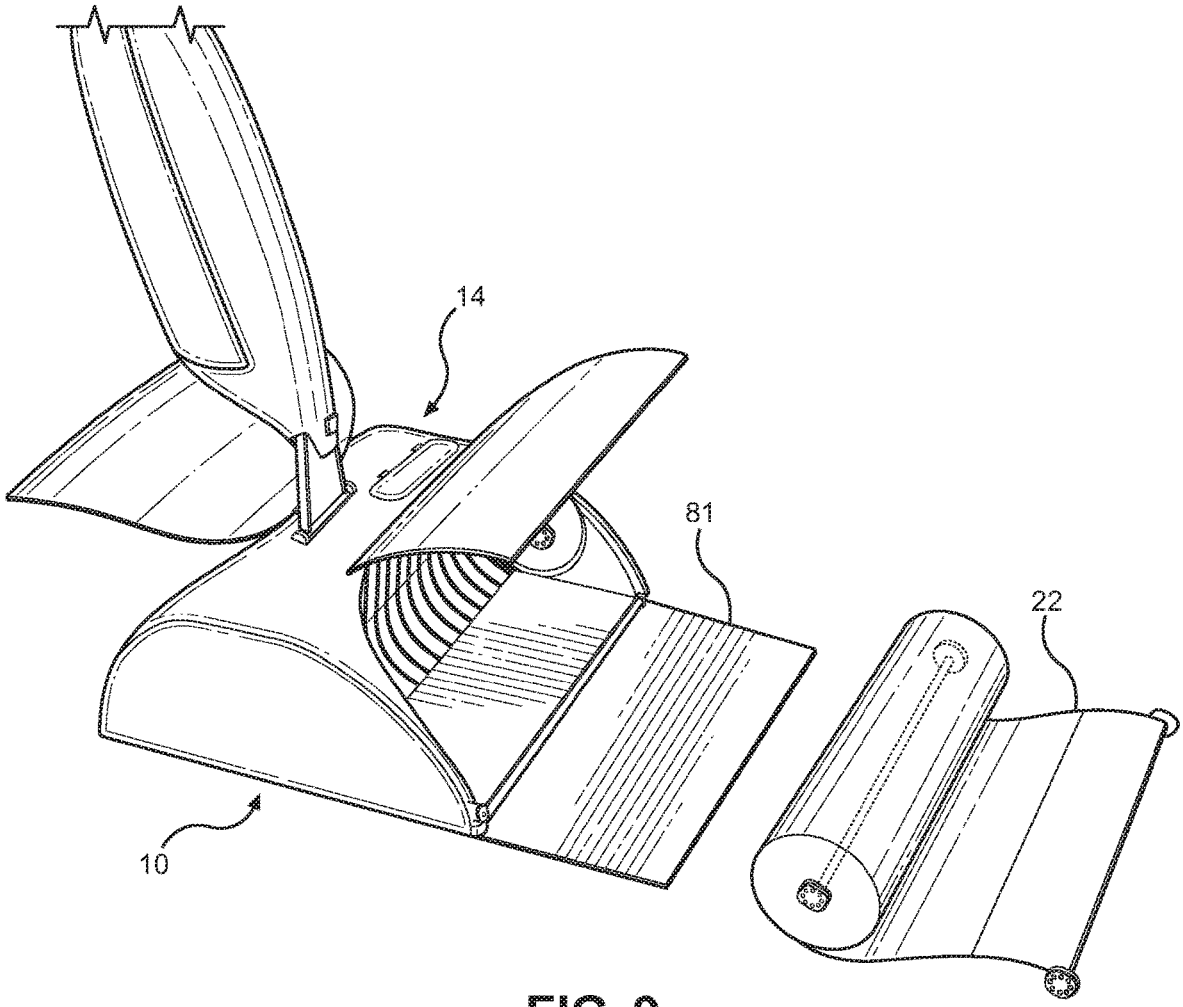
FIG. 9 is a close-up perspective view of an alternate embodiment of the main mop head housing with a front extension.

Referring now to FIGS. 8 and 9, there is shown a perspective view of an alternate embodiment of the present invention with a front extension 81, as well as a close-up perspective view of an alternate embodiment of the main mop head housing 14 with a front extension 81. In this embodiment, the housing 14 includes an extension 81 on the front thereof. The extension increases the amount of material 22 that makes contact with the surface to be cleaned, which extends the useful life of the material 22 and cartridge. The extension 81 also increases the reach of the mop, which enables the device to reach under cabinets, appliances, furniture, and the like. As can be appreciated, the lower height of the extension 81 allows for cleaning of restricted areas that cannot be reached with the housing 14.

In an alternate embodiment the housing can be designed so it is less than four inches in height. As can be appreciated, kitchen cabinet soffits are four inches in height by four inches in depth. A housing that is less than four inches in height would reach underneath the soffit, thereby affording improved cleaning.

Figure 10:
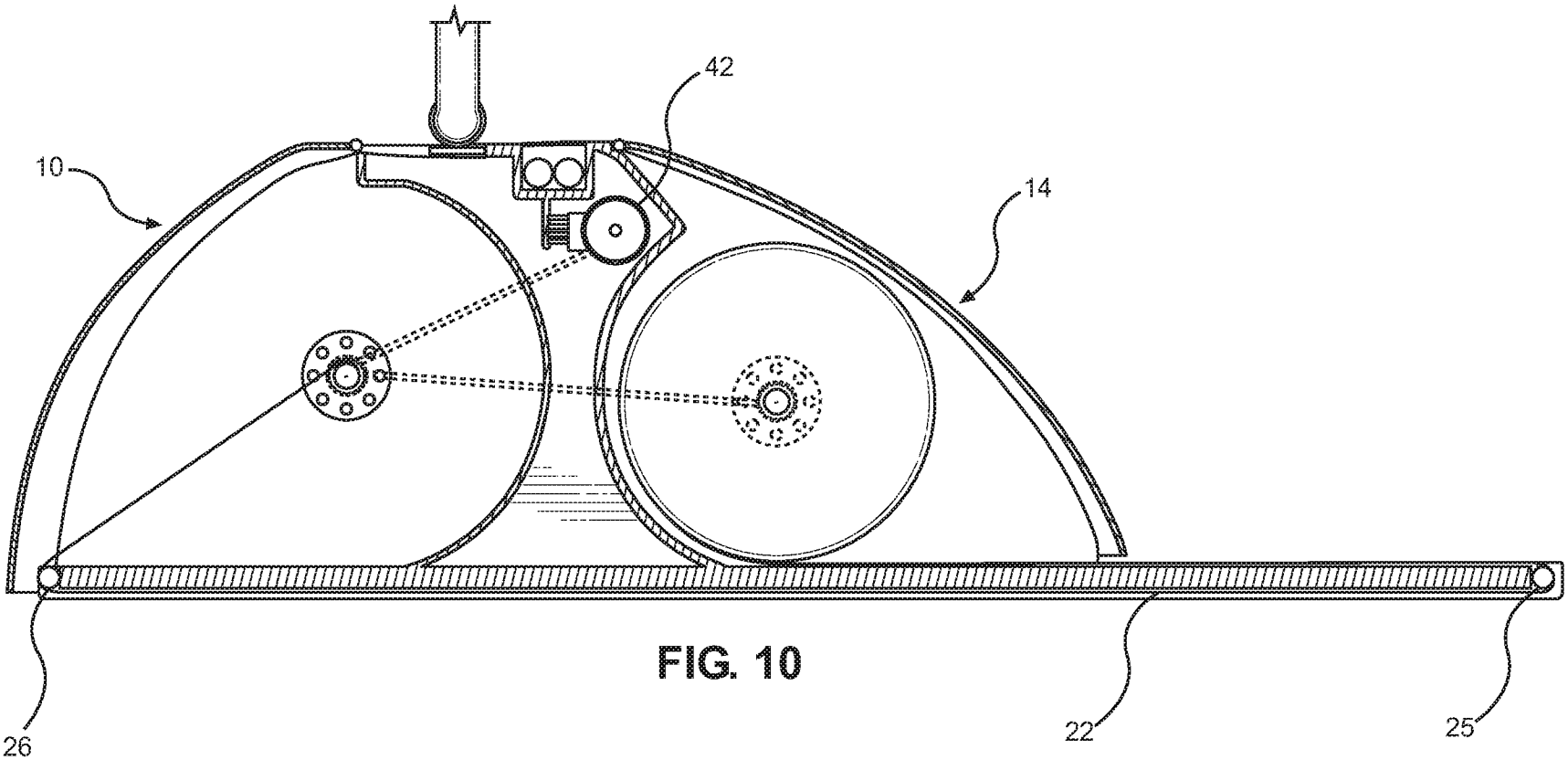
FIG. 10 is a cross-sectional side view of an alternate embodiment of the mop head housing with a front extension.

Referring now to FIGS. 9 and 10, there is shown a close-up perspective view of an alternate embodiment of the main mop head housing 14 with a front extension 81, as well as a cross-sectional side view of an alternate embodiment of the mop head housing 14 with a front extension 81. As shown, the extension 81 extends from the front of the housing 14. The material 22 is secured in place via the first rolling spindle 25 and a second rolling spindle 26. The first rolling spindle 25 is attached to the distal end of the extension 81, and enables the material 22 to advance when the motor 42 is activated. Additionally, the extension 81 can be constructed with a means that enables extension and retraction thereof. A button on the handle may extend or retract the extension 81 as desired.

The shape and design of the housing 14 can be altered to reach from the highest point off the floor at the base of the mop handle and extending out over the extension 81. In this configuration, the first lid 21 reaches out and covers the extension 81. The addition of the housing over top of the extension 81 enables the device to reach under cabinets and other hard to reach areas while affording support and structure to the extension 81.

In a first alternate embodiment, the mop of the present invention includes a means for cleaning the material as it enters back into the housing. Preferably, this is accomplished with a set of scrapers (not shown) attached to the housing to remove any debris attached thereto, and to store the debris in a storage compartment (not shown). In a second alternate embodiment, the mop includes a combination of a spray system and a steam system. The user can select one or both systems for cleaning as desired.

In a second alternate embodiment, the mop of the present invention may be automated and designed as a self-cleaning system. In this embodiment the mop may function as an automated robotic floor cleaner. The device can be programmed and/or can learn the shape and configuration of the area to be cleaned, and can be programmed to clean on a schedule. In this embodiment, the device can include the steam generating function, and can move freely along the surface to be cleaned by means of electronic automation and without the need for human involvement.

The automated system comprises a housing unit, additional motorized wheels for propulsion, and a processor and software for controlling the device. Additionally, the handle may be deleted from this configuration, enabling the device to clean under tables, chairs, and other areas that would make contact therewith. Sensors control the movement of the device across the surface and advance the cleaning material at either a set preprogrammed time (such as, after so many seconds) or after additional sensors determined that a dirt/debris threshold has been reached. Additional sensors or preprogrammed timing can also control the liquid spray being released onto the surface or the amount of steam being applied to a particular surface section. The automated system can also utilize a pre-wetted cleaning cartridge as described above.

Overall, the present invention provides a convenient solution for cleaning surfaces with a new and improved mop. The device prevents the need for buckets and detachable cleaning materials that require constant replacement. The automatic advancement of the material ensures even and consistent cleaning, while the spray nozzles and/or steam generating means assist with hard to clean areas. The extension permits the device to reach areas that often go uncleaned, while the automated embodiment can provide a self-contained cleaning system that does not require human input.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mop, comprising:

a handle, an elongated shaft, a first reservoir, and a housing; said housing comprising a first hinged lid, a second hinged lid, a roved cleaning fabric material cartridge disposed within said housing and covered by said first hinged lid; said material being secured in position with a first rotating roller attached to a first sidewall locking means; a second rotating roller disposed within said housing and covered by said second hinged lid, said second rotating roller being secured in position with a second sidewalk locking mechanism; a first rolling spindle and a second rolling spindle, said material being stabilized and stretched between said first and second spindles; a first and second spray nozzle being fluidly connected to said reservoir for dispensing a solution contained in said reservoir; an extension extending from said housing, said extension being substantially planar and further comprising said first rolling spindle, said extension enabling said mop to reach under cabinets, appliances, furniture, and the like, wherein said extension is capable of extending and retracting, said extending and retracting being activated by a button on said handle; and a motor for advancing said material, wherein said motor is preprogrammed to advance said material so that a completely new section of material covers the mop surface area and said used section of material is advanced into said housing.

2. The device of claim 1, wherein said handle comprises a first control power button for said motor, a second control button for operating said spray nozzle, a third control button for operating said steam mechanism, and a fourth control button for extending and retracting said extension.

3. The device of claim 1, wherein said motor provides power to a rotor, said rotor rotating a gear, wherein said gear applies rotational force to a rear sidewall mechanism in a clockwise or counter-clockwise motion and rotating a second rotating roller.

4. The device of claim 3, wherein said rotation of said second rotating roller advances said material around said roller to enable a new section of said material to advance.

5. The device of claim 1, wherein said cleaning fabric material cartridge is pre-wetted in a sealed bag, wherein said material is pre-wetted with a cleaning solution.

6. The device of claim 1, wherein said mop further comprises motorized wheels, a processor, software, and sensors, said wheels, processor, software, and sensors enabling said mop to operate as an automated, self-cleaning system without the need for human involvement.

* * * * *